US005628347A

United States Patent [19]

Rush

[11] Patent Number: 5,628,347

[45] Date of Patent: May 13, 1997

[54] HEALD CONTROL SELECTION MECHANISM

[75] Inventor: John B. D. Rush, Tyne & Wear, England

[73] Assignee: Bonas Machine Company Limited, Tyne & Wear, England

[21] Appl. No.: 398,368

[22] Filed: Mar. 3, 1995

[30] Foreign Application Priority Data

Nov. 8, 1994 [GB] United Kingdom ..... 9422519

[51] Int. Cl.[6] ..... D03C 3/20

[52] U.S. Cl. ..... 139/455

[58] Field of Search ..... 139/455, 59

[56] References Cited

U.S. PATENT DOCUMENTS

| | | | |
|---|---|---|---|
| 4,067,363 | 1/1978 | Keim . | |
| 4,739,806 | 4/1988 | Palau et al. | 139/455 |
| 4,936,357 | 6/1990 | Keim et al. | 139/455 |
| 5,176,186 | 1/1993 | Bousfield et al. | 139/455 |

FOREIGN PATENT DOCUMENTS 1388654 3/1975 United Kingdom .

*Primary Examiner*—Andy Falik

*Attorney, Agent, or Firm*—Dann, Dorfman, Herrell and Skillman; Henry H. Skillman

[57] ABSTRACT

A heald control selection mechanism including at least one elongate heald rod movable longitudinally between first and second limits of reciprocal motion having heald rod knives continuously reciprocating along a path parallel to the longitudinal axis of the heald rod. The heald rod is biased to normally reside at the first limit of reciprocal motion. The heald rods and knives include cooperating latches which automatically engage when each knife moves relative to the heald rod along said path in a direction toward the second limit of reciprocal motion and which automatically disengage when the knife moves relative to the heald rod along said path in the opposite direction. A heald rod selection control is operable to selectively isolate or inactivate the cooperating latch when the heald rod resides at said first limit of reciprocal motion and on actuation renders active the cooperating latch to enable either knife to move the heald rod toward said second limit of reciprocal motion.

12 Claims, 7 Drawing Sheets

HEALD CONTROL SELECTION MECHANISM

FIELD OF THE INVENTION

The present invention relates to a heald control mechanism.

BACKGROUND OF THE INVENTION

Prior control mechanisms include reciprocating knives which support and displace all of the associated heald rods at all times, until a rod is selected. When a rod is selected, it is supported independently of the reciprocating knives, for example as shown in U.S. Pat. Nos. 4,739,806 and 5,176,186. Since all heald rods except those selected are in continual motion during shed formation, there is considerable wear on the heald rod guide and harness pulleys and the knives are subject to continuous loading.

SUMMARY OF THE INVENTION

The present invention departs from the conventional arrangement by isolating all the heald rods from the knives except those which are selected, so that the knives support and carry only the selected held rods. This isolation is effected by inactivating the latch means which would otherwise engage the non-selected heald rods with the reciprocating knives.

According to one aspect of the present invention there is provided a heald control mechanism including at least one elongate heald rod movable longitudinally between first and second limits of reciprocal motion;

a heald rod motive means continuously reciprocating along a path parallel to the longitudinal axis of the heald rod;

the heald rod being biased to normally reside at the first limit of reciprocal motion;

the heald rod and motive means including co-operating latch means which automatically engage when the motive means moves relative to the heald rod along said path in a direction toward the second limit of reciprocal motion and which automatically disengage when the motive means moves relative to the heald rod along said path in the opposite direction; and heald rod selection control means operable to selectively isolate the co-operating latch means when the heald rod resides at said first limit of reciprocal motion and which on actuation renders active the co-operating latch means to enable the motive means to move the heald rod toward said second limit of reciprocal motion.

Preferably the heald rod selection control means includes a shield located adjacent to the heald rod when at its said first limit of reciprocal motion, the shield being arranged to disengage the co-operable latch means as the motive means and heald rod engaged therewith approach said first limit of reciprocal motion, the shield thereafter serving to isolate or inactivate the co-operable latch means to thereby prevent said automatic engagement. Preferably the heald rod selection control means further includes heald rod displacement means for moving a heald rod from said first limit of reciprocal motion partially toward said second limit of reciprocal motion so as to move the heald rod to an intermediate position whereat automatic engagement of the co-operating latch means can occur.

The displacement means and heald motive means may be synchronized so that the co-operating latch means move into engagement while the heald rod is being lifted by the displacement means to said intermediate position. Alternatively the heald displacement means and heald motive means may be synchronized such that the heald rod is moved to and held at said intermediate position prior to engagement of the co-operating latch means.

Preferably the heald rod motive means comprises a pair of knives which reciprocate 180° out of phase along linear paths on opposite sides of the heald rod.

Preferably a selectively operable latch means is located along the path of reciprocal motion of the heald rod, the selectively operable latch means on actuation serving to arrest motion of the heald rod when moving from said second limit toward the first limit of reciprocal motion and thereby cause the heald rod to be held by the selectively operable latch means and simultaneously automatically disengaged from the motive means.

The displacement means may comprise said selectively operable latch means which is movably mounted for reciprocal movement along a path parallel to the longitudinal axis of the heald rod, the selectively operable latch means co-operating with a displacement latch formation located on the heald rod at a position adjacent to the selectively operable latch means when the heald rod resides at its first limit of reciprocal motion.

Reciprocal movement of the selectively operable latch means may be achieved via a cam drive or via the heald rod motive means.

Alternatively, the displacement means may comprise secondary heald rod motive means which continuously reciprocally move a heald rod from its first limit position to said intermediate position, the selectively operable latch means being stationarily mounted and co-operating with a displacement latch formation located on the heald rod at a position adjacent to the selectively operable latch means when the heald rod resides at said intermediate position, the selectively operable latch means on actuation serving to retain the heald rod at said intermediate position to thereby enable the co-operable latch means to automatically engage to move the heald rod to said second limit of reciprocal motion.

Preferably the secondary heald rod motive means includes cam means operable on all heald rods so as to move all heald rods in unison to said intermediate position.

BRIEF DESCRIPTION OF THE DRAWINGS

Various aspects of the present invention are hereinafter described with reference to the accompanying drawings, in which.

DESCRIPTION OF THE PREFERRED EMBODIMENTS

Figure 1:
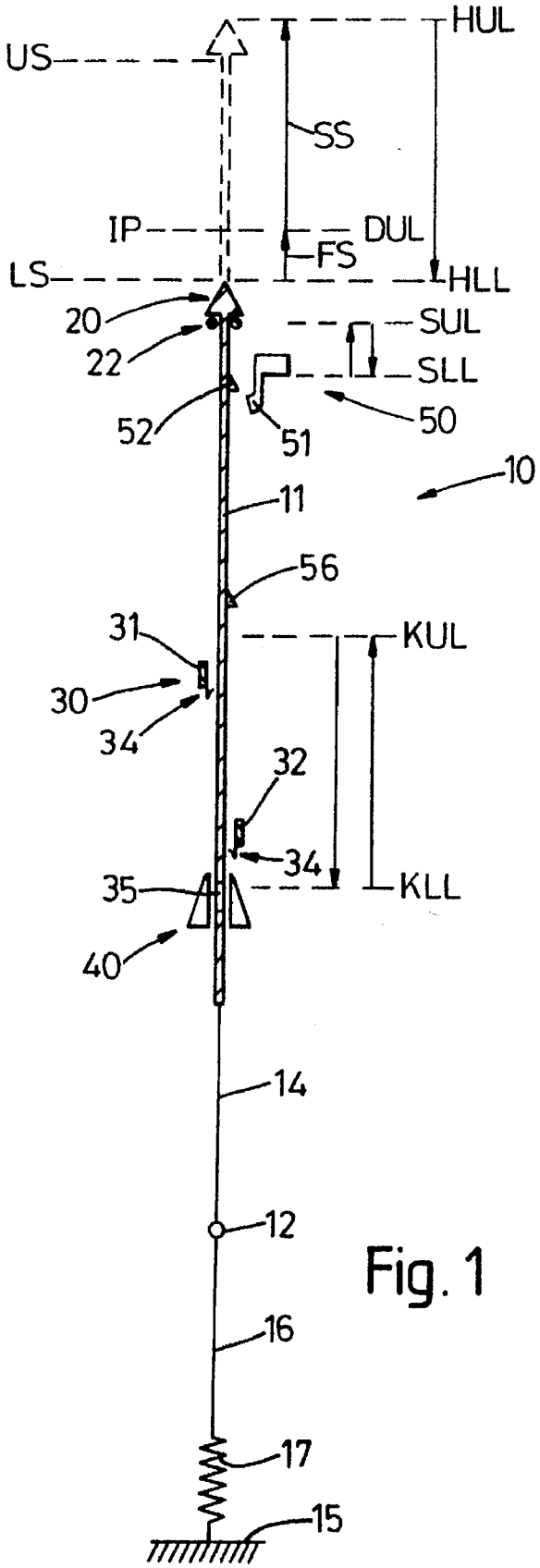
FIG. 1 is a diagrammatic side view of a heald control mechanism according to a first embodiment of the present invention.

Referring initially to FIG. 1 there is shown a diagrammatic representation of a heald control mechanism 10 which includes a plurality of elongate heald rods or hooks 11 (only one being visible in FIG. 1 ) each of which is movable longitudinally between a lower limit HLL and an upper limit HUL of reciprocal motion. Each heald rod 11 is rigid and is connected at its lower end to a heald eye 12 via a harness cord 14. The heald eye 12 is in turn connected to the frame 15 of the mechanism via a cord 16 and spring 17.

The heald rod 11 includes a stop formation 20 which limits the downward movement of the heald rod 11 by engagement with a static stop 22 formed on the frame of the mechanism.

Accordingly, in the position shown, the heald rod 11 is biased into contact with the stop 22 by virtue of the spring 17 and so is retained in its lower limit of reciprocal motion HLL. Conveniently this position is chosen to correspond to the lower shed position for the heald eye 12.

Primary rod motive means 30 are provided for reciprocally moving the heald rod 11 between its upper and lower limit positions HUL and HLL respectively.

The heald rod motive means 30 preferably comprises a pair of knives 31, 32 which reciprocate along a linear path parallel to the longitudinal axis of the heald rod 11. The knives 31, 32 are located on opposite sides of the heald rod 11 and continuously reciprocate between an upper limit KUL and a lower limit KLL of reciprocal motion; the knives 31, 32 reciprocating 180° out of phase.

The knives 31, 32 are each provided with latch means 34 which co-operate with latch means 35 formed on the heald rod 11.

Accordingly, during reciprocal motion of the knives 31, 32 the co-operating latch means 34, 35 move relative to one another in the longitudinal direction of the heald rod 11 when the heald rod is held stationary. The co-operating latch means 34, 35 are formed such that when the latch means 34 move relative to the heald rod 11 in a direction toward the upper limit HUL they automatically engage with latch means 35 to cause the heald rod 11 to be supported by the knife 31 or 32 on which the engaged latch means 34 are mounted.

The co-operating latch means 34, 35 are also formed such that when the latch means 34 move relative to the heald rod 11 in a direction toward the lower limit HLL they either automatically disengage from the latch means 35 (if co-operating latch means 34, 35 are engaged) or pass by latch means 35 without engagement.

The latch means 34, 35 also co-operate such that when the latch means 34 on one knife are engaged with latch means 35, the latch means 34 on the other knife are rendered in-operative from engaging the latch means 35. This feature prevents the heald rod 11 when being lowered by one knife travelling toward its KLL position from being engaged and transferred to the other rising knife travelling toward its KUL position as both knives pass one another.

A latch disengagement means 40 is located in the lower region of the path of reciprocal motion of the knives 31, 32 adjacent to lower limit KLL and is positioned so as to extend between the heald rod 11 and respective knives 31, 32.

The latch disengagement means 40 serves two functions. Its first function is to automatically disengage engaged co-operating latch means 34, 35 as one of the knives 31 or 32 carrying the heald rod 11 approaches the lower limit position KLL. On disengagement, the heald rod 11 moves under the bias of spring 17 to its lower limit position HLL whilst the knife 31 or 32 moves towards its lower limit position KLL.

When the heald rod 11 is at its lower limit position KLL, the latch means 35 is located within the latch disengagement means 40 and while in this position is shielded from the latch means 34 on either knife 31 or 32. This defines the second function of the latch disengagement means 40, ie to isolate or shield the latch means 34 and 35 from one another and inactivate the same; such that the heald rod 11 remains at its lower limit position KLL.

Thus all heald rods 11 remain at their lower limit position HLL until selected for raising toward their upper limit position HLL.

Movement of a selected heald rod 11 to its upper limit position HUL is performed in two stages.

The first stage (indicated diagrammatically as FS) comprises moving a selected heald rod 11 from its lower limit position HLL in the direction toward the upper limit HUL so as to move the latch means 35 out of the latch disengagement means 40 to an intermediate position whereat the latch means 35 can co-operate with latch means 34.

The second stage (indicated diagrammatically as SS) comprises the co-operating latch means 34, 35 automatically engaging one another and the associated knife 31 or 32 then carrying the heald rod 11 to its upper limit position HUL.

In the embodiment of FIGS. 1 to 4, movement of a selected heald rod 11 during the first stage FS is achieved by a heald rod displacement means 50 which continuously reciprocates along a linear path parallel to the longitudinal axis of the heald rod 11 between an upper limit SUL and a lower limit SLL.

The heald rod displacement means 50 includes a selectively operable latch means 51 which co-operates with a displacement latch means 52 formed on the heald rod 11.

The latch means 51 is normally in a non-latch condition whereat there is no engagement between latch means 51 and 52. Accordingly the heald rod 11 normally resides at lower position HLL until it is selected for raising.

The reciprocal path of motion between limits SUL and SLL is located such that the lower region of the reciprocal path adjacent to limit SLL is lower than the latch means 52 when the heald rod 11 is located at its lower position HLL.

On actuation of the latch means 51 to a latch condition, the latch means 51 and 52 co-operate to engage one another for raising the selected heald rod 11 from its lower limit HLL toward an upper limit DUL (corresponding to said intermediate position) determined by the heald rod displacement means 50.

The frequency of the reciprocal motion of the heald rod displacement means 50 is chosen to be twice that of the frequency of reciprocal motion of each of the knives 31, 32 and is synchronized such that the heald rod displacement means 50 rises in a direction toward HUL while each knife 31 or 32 is rising from its lower limit position KLL in order to raise a selected heald rod 11 and move its latch means 35 out of the shield 40 in readiness to enable automatic engagement between latch means 34, 35. This synchronized motion may be such as to enable the latch means 34, 35 to engage whilst the heald rod 11 is in motion toward limit DUL and so reduce engagement shocks. Alternatively the synchronized motion may be such that the heald rod 11 is moved to the intermediate position (corresponding to limit DUL) and held there prior to engagement between latch means 34,35.

The synchronized motion is also arranged such that during the time that the knife 31 or 32 carries the heald rod 11 to its upper limit position HUL, the heald rod displacement means 50 returns to and preferably dwells at its lower limit position SLL in readiness for upper shed selection. It will be appreciated, however, that once the heald rod 11 has been engaged by a knife 31 or 32 for lifting to upper shed position, the position of the rod displacement means 50 between limits SUL and SLL is not critical for upper shed selection.

Upper shed selection is preferably achieved using the same latch means 51 which co-operates with a shed latch means 56 formed on the heald rod 11.

The shed latch means 56 is positioned on the heald rod 11 so as to be located above the latch means 51 when the heald rod 11 is located at its upper limit position HUL.

Accordingly, provided that latch means 51 are actuated to its latch condition, on lowering of the heald rod 11 from its upper limit HUL the co-operating latch means 51 and 56 will inter-engage and arrest further downward motion of the heald rod 11.

Continued downward motion of the knife 31 or 32 is permitted since co-operating latch means 34, 35 will automatically disengage as soon as the motion of the heald rod 11 is arrested by latching between latch means 51, 56.

The heald rod 11 remains at its upper shed position, being retained by co-operating latch means 51, 56, until the next knife 31 or 32 rises. When the next knife rises, its latch means 34 co-operates with latch means 35 to cause automatic engagement and raising of the heald rod 11 toward its upper limit HUL from its upper shed position US.

Such movement of the heald rod 11 causes disengagement of the co-operating latch means 51 and 56. Accordingly, if the latch means 51 is not actuated again to its latch condition, the heald rod 11 will be carried by the knife to its lower limit position HLL.

Preferably the latch means 51, 56 and/or latch means 51 and 52 co-operate to enable pre-selection to occur ie. the latch means 51 may be actuated to its latched condition at a desired predetermined time prior to latching engagement between latch means 51 and latch means 52 or 56. For instance the latch means 51 may be actuated to move to its latch condition while the heald hook 11 is rising toward its upper position HUL and before the respective latch 52 or 56 passes by the latch means 51. The co-operating latch means 51, 52 and 56 are arranged such that the latch means 52, 56 may pass by the actuated latch means 51 without latching engagement as the hook 11 moves in the direction toward upper position HUL but are such that as the latch means 52, 56 latchingly engage the actuated latch means 51 when the latch means 52, 56 approach latch means 51 during movement of the heald hook 11 toward its lower position HLL.

Pre-selection provides a longer time period for enabling the latch means 51 to move from its non-latch to its latch condition and so in the case where the latch means 51 utilises an electro magnet for its actuation, it is possible to use a slower, less powerful electromagnet.

Figure 6:
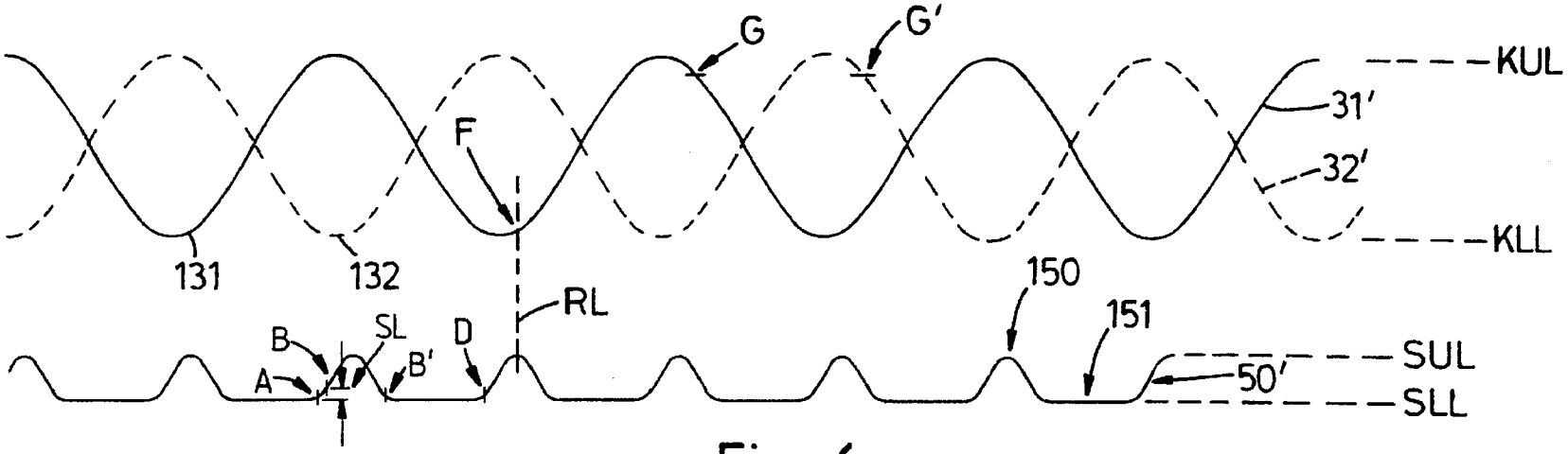
FIG. 6 is a graph showing the relative motion between the heald rod motive means and the heald rod displacement means in the first embodiment.

FIG. 6 illustrates a suitable synchronized motion between the knives 31, 32 and the heald rod displacement means 50.

In FIG. 6 the reciprocal motion of knife 31 is illustrated by solid line graph 31' and the reciprocal motion of knife 32 is illustrated by broken line 32'. In both cases the motion is sinusoidal; the motions being out of phase by 180°.

The motion of the heald rod displacement means 50 is illustrated by line 50'; the motion comprises sharp peaks 150 separated by flat troughs 151.

The wave length of the motion 50' is half that of motions 31' and 32' and is phased such that the crest of each peak 150 lags slightly behind the base of successive troughs 131, 132 (as indicated by reference line RL). This degree of the lag is chosen to ensure that a selected heald rod 11 is raised toward its intermediate position (corresponding to the peak 150) as a knife 31 or 32 rises from its lower limit KLL and thereby ensure engagement between latch means 34, 35.

The distance by which latch 51 lies below latch 52 when the heald rod 11 is at its lower position HLL is illustrated as the gap SL between points A and B on motion 50'.

Accordingly after the displacement means 50 has risen to point B it is possible to actuate latch means 51 since it has now risen above co-operation latching means 52 and cannot latching engage therewith until it is lowered again; this is illustrated as point B'.

Once the displacement means 50 has been lowered below point B', latch means 51 would now be positioned beneath latch means 52 such that subsequent raising of latch means 51 will cause raising of the associated heald hook 11.

Thus providing that latch means 51 is actuated at some point during the phase between points B and D raising of the selected hook 11 will occur; D being the equivalent point corresponding to B but on the next succeeding waveform.

Once the latch means 34, 35 have engaged, the heald rod 11 is supported by a knife 31 or 32. This is represented by point F on the motion graph 31'.

The point at which latching occurs between latch means 51 and 56 for holding the heald rod 11 at top shed position is designated as point G.

Accordingly latch means 51 may be de-activated to its non latch condition after point F but then actuated to its latch condition at a suitable time prior to reaching point G or alternatively, the latch means 51 may remain continuously actuated in its latch condition between points F and G.

After point G, the latch means 51 will be de-activated to its non latch condition if the heald rod 11 is not to be retained at top shed for the next pick.

If the heald rod 11 is to be retained at top shed for the next pick, then the latch means 51 may remain actuated so that when the heald rod 11 is next raised by knife 32 to its upper limit HUL, the latch means 51 is able to retain the heald hook 11 at the upper shed position.

Alternatively, the latch means 51 may be de-activated and then subsequently actuated at any desired point on the graph 32' prior to knife 32 lowering the heald rod 11 from its upper limit HUL to point G'.

Figure 7:
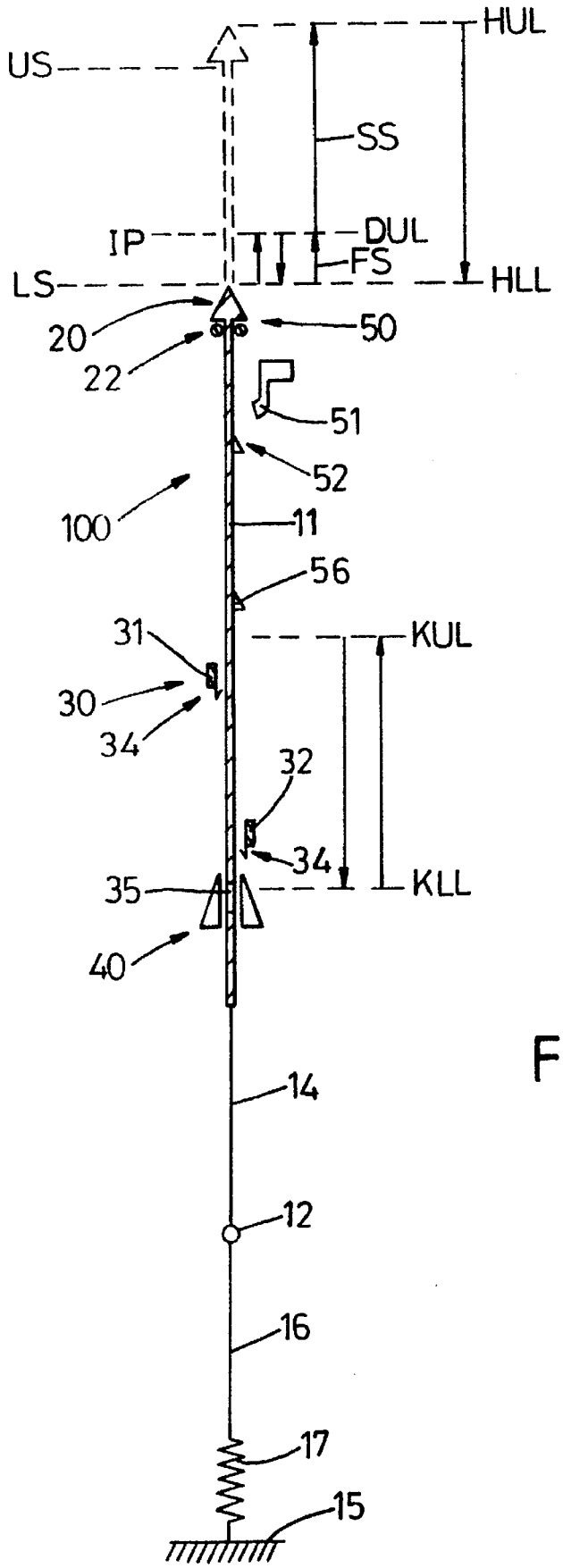
FIG. 7 is a diagrammatic side view of a second embodiment according to the present invention.

A further embodiment 100 is illustrated in FIG. 7 in which parts corresponding to those in FIG. 1 have been designated by the same reference numerals.

The embodiment 100 differs from embodiment 10 in that the latch means 51 does not define the heald rod displacement means 50, viz latch means 51 remains stationery and so does not reciprocate between limits SUL and SLL. Instead the heald rod displacement means 50 is defined by stop 22 which is arranged to continuously reciprocate in order to move the heald rod 11 continuously between its positions HLL and DUL.

The latch means 52 in embodiment 100 is located so as to be positioned below latch means 51 when the heald rod 11 is at its lower position HLL but to be above latch means 51 when at position DUL by a sufficient gap to enable latching engagement between latch means 51 and 52.

If the heald rod 11 is to be selected for raising to the upper shed position, then latch means 51 is actuated to its latch condition and holds the heald rod 11 at its intermediate position IP for engagement with the knife 31 or 32.

In embodiment 100 all heald rods 11 are simultaneously and continuously reciprocally moved between positions HLL and DUL in readiness for selection. Since the latch means 51 is not reciprocated, it is isolated from vibrations caused by reciprocation and so facilitates reliable selection using lower powered electromagnets.

Figure 8:
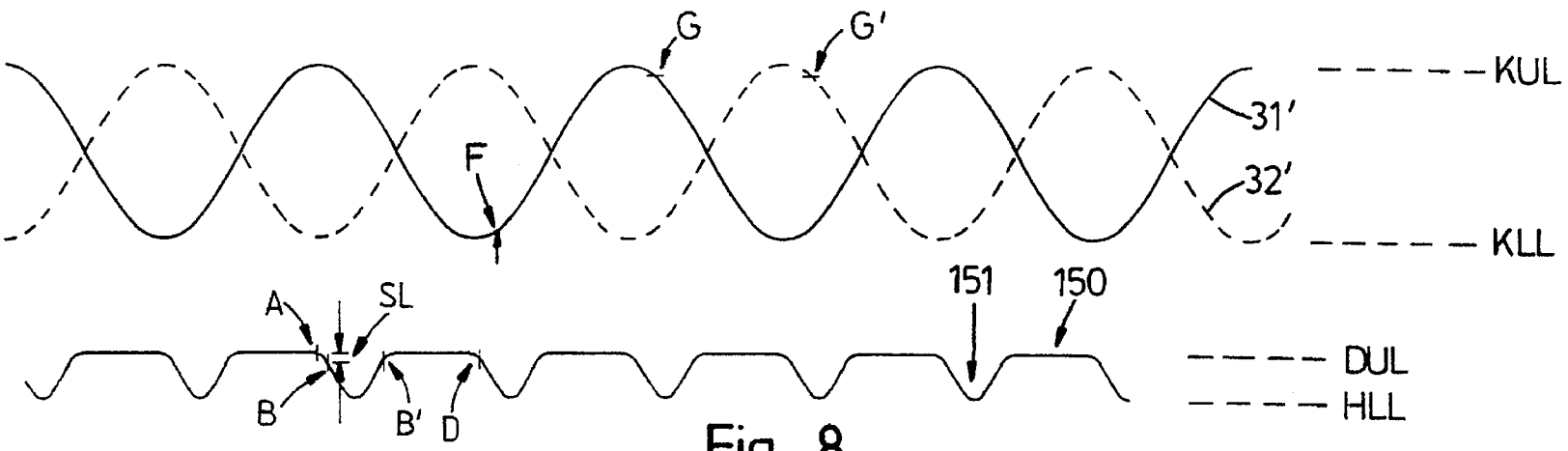
FIG. 8 is a graph showing the relative motion between the heald rod motive means and the heald rod displacement means in the second embodiment.

FIG. 8 illustrates a suitable synchronized motion between knife 31, 32 and the heald rod displacement means 50 in embodiment 100. The motion shown in FIG. 8 differs in that the peaks 150 are defined by flat plateaux and the troughs 151 are sharp.

In the embodiment 10, 100 described above a single latch means 56 is provided for defining the upper shed position.

It will be appreciated that several shed latch means similar to latch means 56 may be provided at spaced intervals along the heald rod 11 inbetween the latch means 56 and 52. This would enable different upper shed positions to be achieved by actuating the latch means 51 whilst the heald rod 11 is descending from its upper limit HUL to engage a desired latch means 56. Alternatively, the stroke of knives 31, 32 may be reduced in order to lower the position of limits KUL and HUL to correspond for operation with a selected latch means 56.

A preferred detailed construction of a heald control mechanism according to embodiment 10 will now be described with reference to FIGS. 2 to 4.

Figure 2:
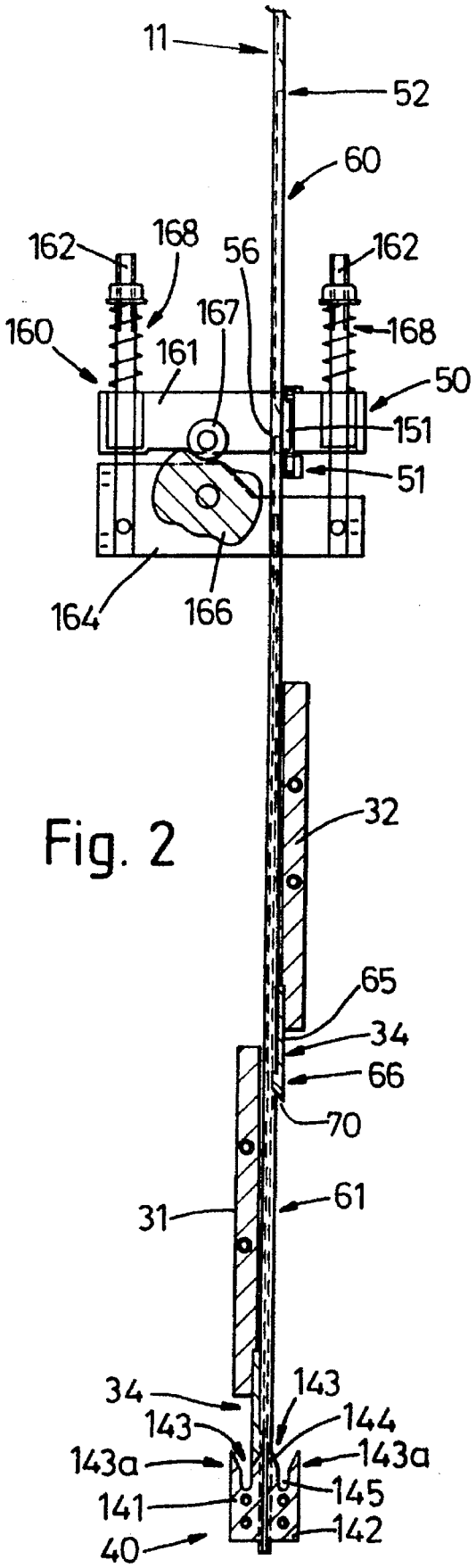
FIG. 2 is a more detailed side view of the first embodiment according to the present invention with the heald rod at its upper limit HUL.
Figure 2A:
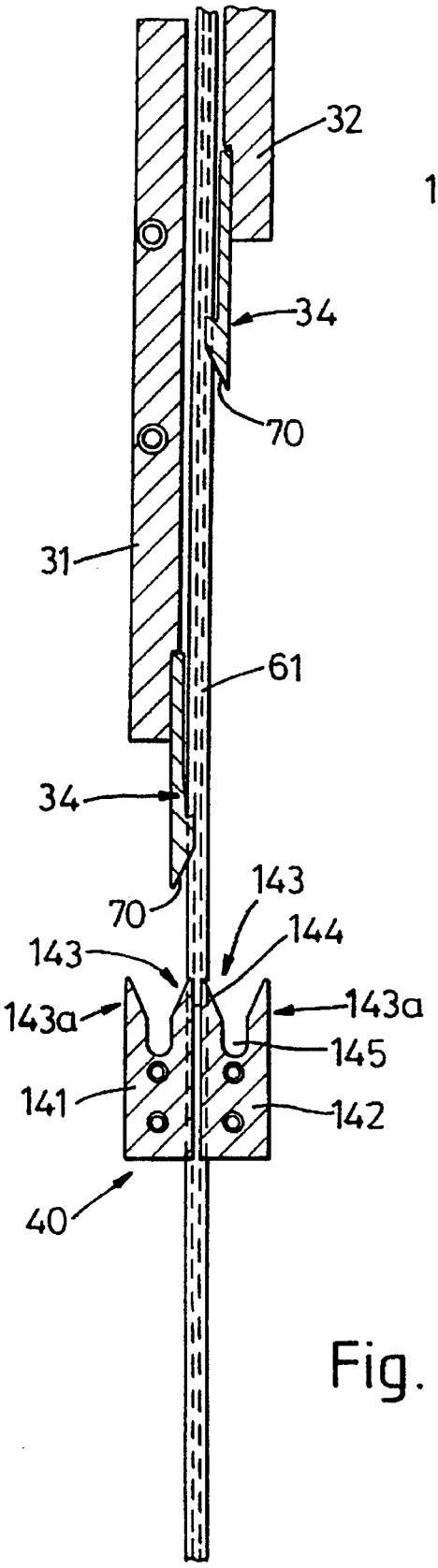
FIG. 2*a* is an enlarged view of the lower part of the first embodiment as shown in FIG. 2.
Figure 3:
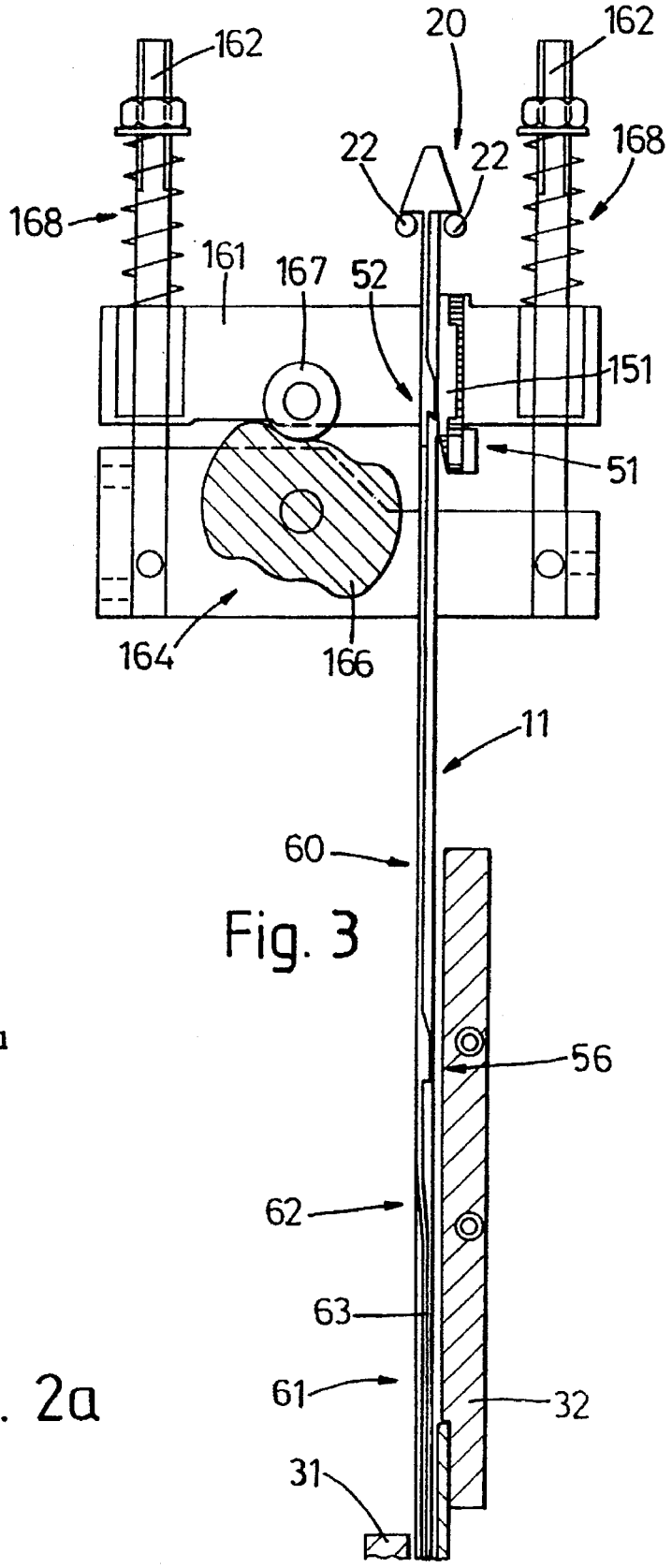
FIG. 3 is a similar view to FIG. 2 showing the upper portion of the first embodiment with the heald rod at its lower limit HLL.
Figure 4:
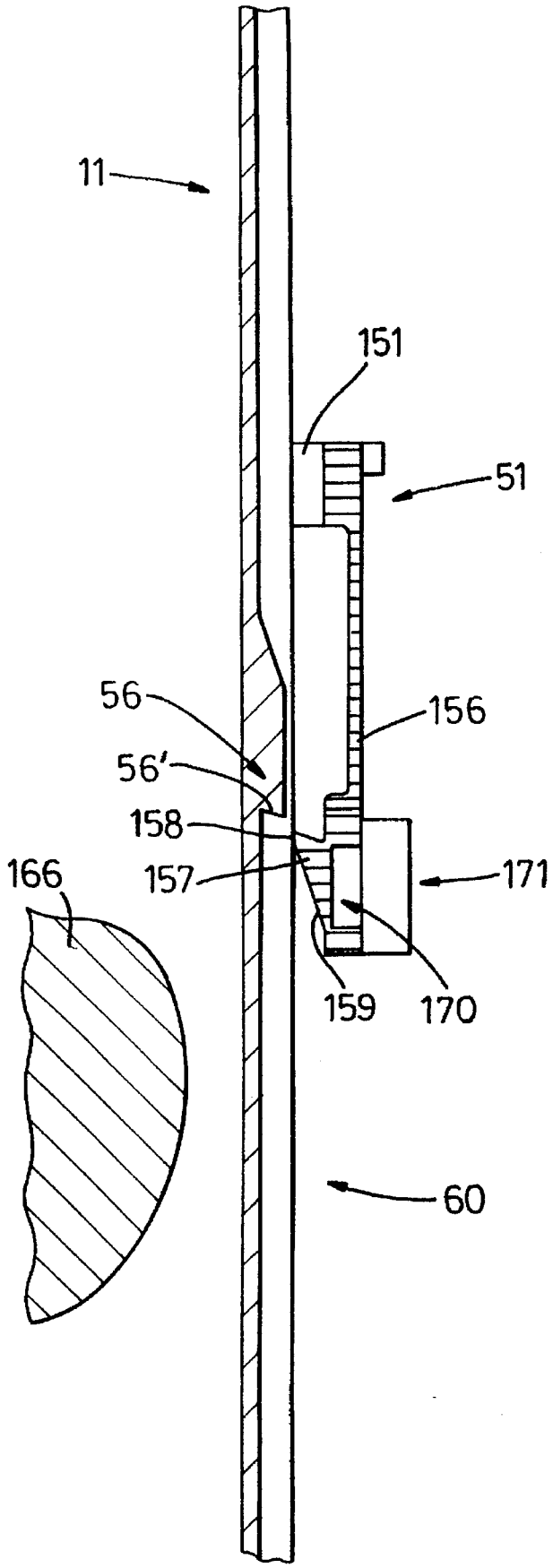
FIG. 4 is an enlarged view of part of the mechanism shown in FIGS. 2 and 3.

In the embodiment of FIGS. 2 to 4, a row of heald rods 11 is provided; the heald rods 11 in the row being arranged side by side and spaced along and inbetween knives 31, 32. Each heald rod 11 is of constant outer dimensions along its length, viz has a constant width and depth and is preferably formed so as to have a first elongate body portion 60 having a 'U' channel section and a second elongate body portion 61 of 'T' cross-section; the transition 62 between the portions 60, 61 being located beneath the lowermost upper shed latch means 56.

The wall thickness throughout is preferably about 1 mm and the outer width and depth dimensions are preferably about 6 mm and 3 mm respectively.

Thus the body portion 60 has a channel having a depth of 2 mm and width of 4 mm; the body portion 61 having two channels located either side of a central web 63, these channels having a width of 4 mm and depth of 1 mm.

The U-section of body portion 60 enables the latch means 56 to have a bottom latch shoulder 56' of maximum depth of 2 mm.

It is envisaged however, that the heald rod 11 may be of constant 'T' cross-section throughout its length and that the latch means 52 and 56 may be defined by an aperture in the heald rod.

The latch means 34 for each knife 31, 32 is preferably in the form of a resilient tongue 65 secured at one end to the knife and having a terminal head 66 biased into sliding contact with the web 63. A row of side by side tongues 65 extending along each knife 31, 32 is provided so that two opposed tongues 65 are provided for co-operation with each heald rod 11.

The width of the tongue head 66 is less than 4 mm so that the head 66 can slide within the facing channel of the heald rod portion 61 and be guided by the side walls of the channel.

The longitudinal extent of the second body portion 61 preferably exceeds the combined reciprocal displacement of the knives between limits KUL and KLL and the heald rod 11 between limits HUL and HLL such that the tongues 66 continuously slide within the facing channel irrespective of the displacement of the knives 31, 32 or heald rod 11. The latch means 35 preferably comprises a slot 35 passing through web 13 and into which the head 66 is biased to enter.

The tongue head 66 has a shoulder which engages with the upper edge of the slot 35 such that the heald rod 11 is carried thereby.

The tongue head 66 has an inclined leading face 70 which on movement of the tongue head 66 in a direction toward limit KLL relative to the heald rod 11 enters into the slot 35 and co-operates with the lower edge of the slot to urge the head 66 out of the slot 35 as the head 66 continues to move relative to the heald rod 11 in said direction.

The head 66 when engaged in slot 35 preferably projects through the web 63 by a sufficient distance to shroud the upper edge of the slot from the tongue head 66 located on the opposite side of the heald rod 11.

Accordingly, one tongue head 66 only is able to engage the upper edge of the slot 35 at any one time.

Figure 5A:
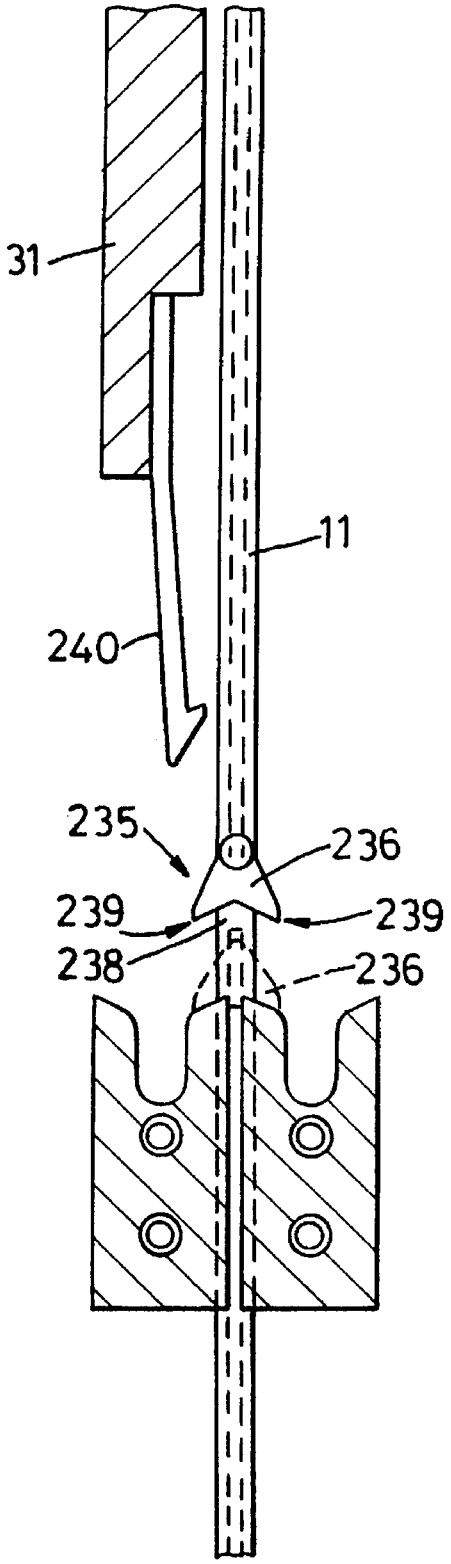
FIG. 5*a* and 5*b* are enlarged part views of a heald rod showing an alternative latch means.
Figure 5B:
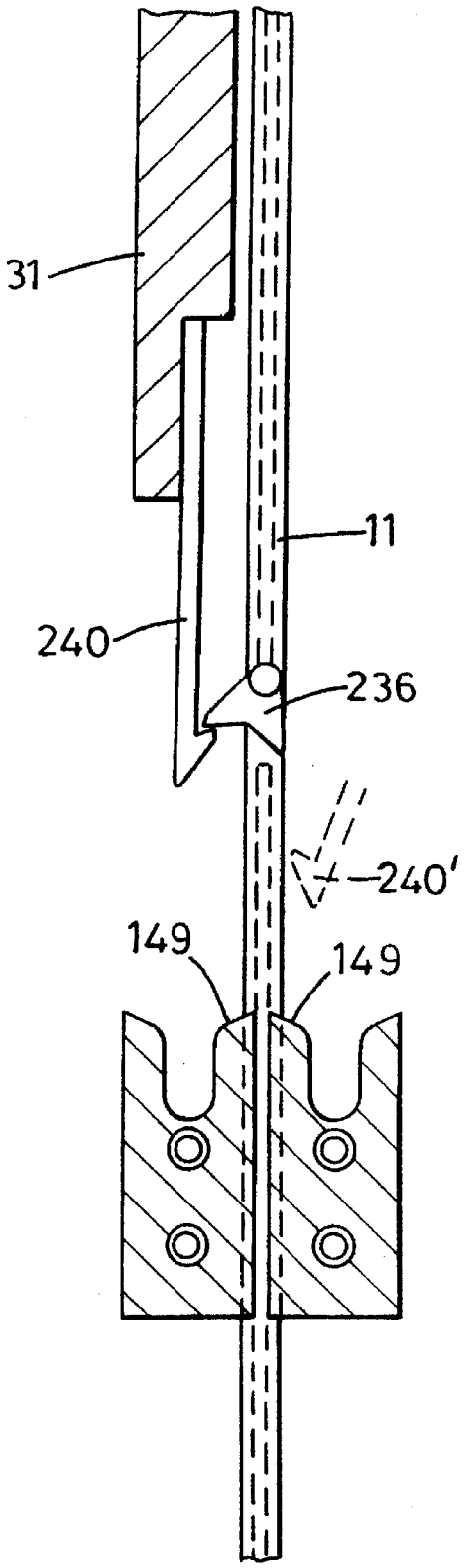

An alternative form of latch means 34, 35 may comprise a deflectable latch member 235 movably mounted on the heald rod 11, (see FIG. 5*a*, 5*b*). The latch member 235 comprising a body 236 of generally triangular cross-section which is pivotally connected at its top portion to the heald rod 11. The body 236 resides in a window or aperture 238 formed in the heald rod 11 and so is able to move about the pivotal connection to one side or other of the heald rod 11.

The body 236 has lower side edges 239 which define latching edges for co-operation with latch members 240 formed on the knives 31, 32. Although latch members 235 are movable, latch members 240 are preferably deflectable and resiliently biased for contact with the heald rod 11 in order to permit de-latching by the latch disengagement means 40. The lower side of the latch member 235 is preferably recessed such that latching engagement with a latch member 240 causes the latch member 235 to swing outwardly about its pivot to a latching position. Such movement of the latch member 240 causes the latching edge 239 on the opposite side of the heald rod 11 to retract into the window 238 and so prevents its engagement with the latch member 240' located on that side (see FIG. 5*b*).

When not engaged by a latch member 240, the latch member 235 resides at a central position in readiness to be latchingly engaged from either side of the heald rod 11. The latch member 235 may be biased to its central position by gravity and/or resilient means.

In FIG. 5*a*, the heald rod 11 is illustrated in a raised position in readiness for engagement between latches 240 and 235. When the heald rod 11 is at its lower position HLL the latch member 235 rests upon the upper edges 149 of the latch disengagement means 40 (as shown in broken lines in FIG. 5*a*). The upper edges 149 are wider than edges 239 and so in this position, the lower edges 239 are shielded and cannot be engaged by the latch members 240.

The latch disengagement means 40 preferably comprises a pair of elongate bodies 141,142 secured to the frame of the mechanism. The bodies 141, 142 are arranged side by side and are spaced apart to define a gap for slidably receiving the central web 63 of body portion 61. The bodies 141, 142 also include opposed grooves for slidably receiving the side walls of the body portion 61.

Accordingly, the latch disengagement means 40 serves to slidingly guide longitudinal movement of each heald rod 11 in the row.

Each body 141, 142 includes a latch deflection formation 143 extending along its length defined by an inclined face 144. In use as each knife approaches its lower limit KLL the inclined face 70 on each tongue of the latch 34 engages face 144 and is deflected laterally away from each heald rod 11. The bodies 141,142 shown include an additional latch deflection formation 143*a* intended for co-operation with an adjacent row of heald rods (not shown). In order to accommodate for travel of the tongue knife latch 34 over the inclined faces 144 a channel 145 is provided.

The heald rod displacement means 50 comprises an elongate latch support body 151 which is slidably mounted on the frame of the mechanism for vertical movement in a direction parallel to the longitudinal axis of each heald rod in the row.

The support body 151 extends along the row of heald rods 11 and carries a latch means 51 for each heald rod 11 in the row. The support body 151 is connected at each end to a reciprocal drive means 160 (only one of which is shown) for causing vertical reciprocal displacement of the support body 151.

Each drive means 160 includes a support body carrier 161 which is slidably mounted on a rotary shaft in the pair of guide posts 162. The guide posts 162 are mounted in a support member 164 secured to the frame of the mechanism.

A cam 166 is rotatably mounted on support member 164 and co-operates with a cam follower 167 mounted on the carrier 161. The carrier 161 is biased by springs 168 toward the support member 164 and so rotation of the cam 166 causes the carrier 161 to reciprocate.

The cam 166 is rotated in synchronism with the knives 31, 32 to obtain the desired timing for causing the first stage of displacement of a selected heald rod 11 as previously discussed.

Each latch means 51 (FIG. 4) preferably comprises a resiliently deflectable tongue 156 having a head 157 for engagement with either displacement latch means 52 or shed latch means 56.

The head 157 has a shoulder 158 for engagement with latch means 52, 56 and has a leading inclined face 159.

Preferably the head 157 includes a permanent magnet 170 which co-operates with a solenoid 171 which is fixedly mounted on the support 151 by a connection (not shown). The solenoid 171 is preferably an air cored solenoid, ie. a solenoid which does not include a ferro magnetic core, but may include a core of a para or diamagnetic material. It is possible however to use a solenoid having a ferromagnetic core. Actuation of the solenoid 171 creates a repulsive force on the permanent magnet 170 and thereby causes the head 157 to quickly move to a latching position. Return motion of the head 157 may be achieved by de-activating the solenoid and relying on the resilience of the tongue 156 and/or reversing the polarity of the solenoid 171 so as to attract the permanent magnet. Reversing the polarity may be preferred as it enables the solenoid to be continuously run and thereby reduce thermal shock.

Accordingly, actuating the latch means 56 between its latch and non-latch conditions may be achieved either by switching on and off a solenoid or by continuously running the solenoid and switching its polarity.

A preferred detailed construction of heald control mechanism according to the second embodiment 100 will now be described with reference to FIG. 9.

Figure 9:
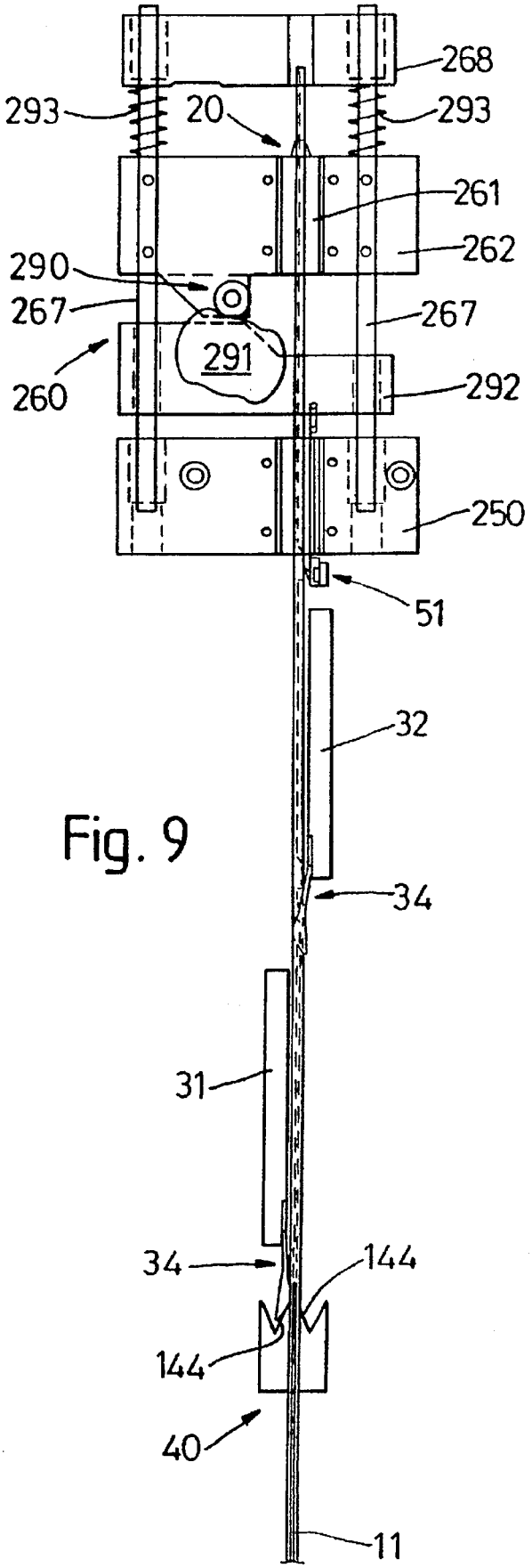
FIG. 9 is a more detailed side view of a heald control mechanism according to the second embodiment.

In FIG. 9 the components corresponding to those in FIGS. 2 to 4 have been designated by the same reference numerals.

The latch means 51 are arranged in a row mounted on an elongate support (not shown) as for embodiment 10. However, the elongate support is mounted at each end in a pair of static support blocks 250 located at each end of the elongate support and secured to the frame (not shown) of the mechanism.

A drive means 260 is located at each end of the elongate support for raising and lowering the heald rods 11.

This drive means 260 includes an elongate support 261 supported at each end by a reciprocating support block 262 (only one shown). Each block 262 is guided during reciprocation by guide rods 267 which are slidingly received at one end in frame member 268 and at the other end in support block 250. Each block 262 has a cam follower 290 which co-operates with a continuously rotating cam 291 mounted on frame member 292. The block 262 is biased by springs 293 so that the cam follower 290 maintains contact with the cam 291. The support 261 has guideways passing therethrough along which each heald rod 11 slidably passes. The stop formation 20 of each heald rod 11 rests upon the upper side of the elongate support 261 so that reciprocation of the support 261 causes the heald rods 11 carried thereby to be reciprocated.

Figure 10:
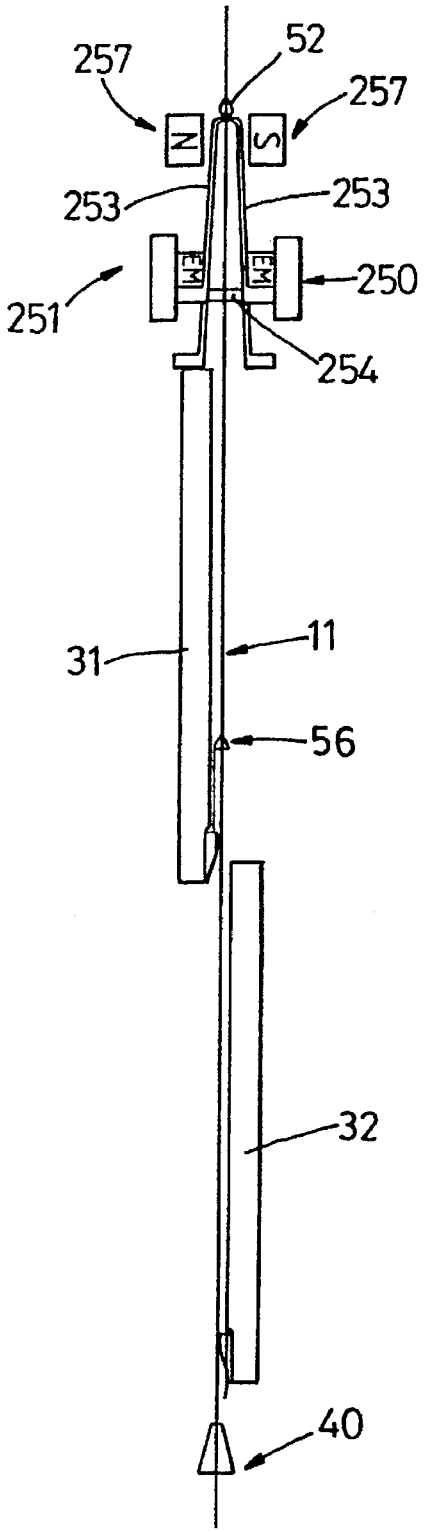
FIG. 10 is a diagrammatic side view of a third embodiment according to the present invention.

A third embodiment is illustrated in FIG. 10.

In FIG. 10 a different arrangement is adopted for moving the latch means 25 1 for causing displacement of a selected heald rod 11. In the embodiment of FIG. 10, the latch means 251 is moved by the knives 31, 32.

The latch means 251 for each heald rod 11 includes a pair of opposed arms 253 which pivot about a fulcrum member 254 so that the upper portions of the opposed arms 253 can move toward or away from one another. The opposed arms 253 are arranged to move independently of one another in the direction of movement of the heald rod 11.

The lower terminal ends of the opposed arms 253 project downwardly to a position below the upper limit KUL so that each time a knife approaches its limit KUL one of the arms 253 is engaged by the knife to cause it to rise.

The upper portions of the opposed arms 253 are normally biased apart by magnetic attraction by a pair of opposed permanent magnets 257 of opposite polarity.

Selection is achieved by actuating an electromagnet 258 which on actuation polarises the arms 253 so as to have a polarity opposing the permanent magnets 257. This causes the upper portion of the opposed arms 253 to pivot toward the heald rod 11 and latch with latch means 52.

In the embodiments described above the latch disengagement means 40 are static and shield the latch means 34, 35 from one another when the heald rods 11 are at their HLL position. Accordingly in order to enable automatic latching to occur between latch means 34, 35 it is necessary to raise each heald hook 11 such that its latch means 35 is located outside the disengagement means 40 so as to be exposed for latching engagement with latch means 34.

It is envisaged that an alternative embodiment may be provided wherein the latch disengagement means 40 may be reciprocally mounted so as to be movable between a de-latch position and a latch position. In the de-latch position the disengagement means 40 operates as described with reference to embodiments one to three to de-latch and shield latch means 34 and 35.

However to achieve movement of a selected heald rod to its upper position HUL, the disengagement means associated with the selected heald rod is moved to its latch position whereat it moves to a location whereat the latch means 35 associated with the selected heald rod 11 is exposed for automatic engagement with latch means 34.

With such an arrangement the selected heald rod 11 is not moved to an intermediate position IP but instead is moved in one continuous movement from its lower position HLL to its upper position HUL by a knife 31 or 32.

I claim:

1. A heald control mechanism including at least one elongate heald rod movable longitudinally between first and second limits of reciprocal motion;

a heald rod motive means continuously reciprocating along a path parallel to the longitudinal axis of the heald rod;

means biasing the heald rod to normally reside at the first limit of reciprocal motion;

the heald rod and motive means including co-operating latch means which automatically engage when the motive means moves relative to the heald rod along said path in a direction toward the second limit of reciprocal motion and which automatically disengage when the motive means moves relative to the heald rod along said path in the opposite direction; and heald rod selection control means operable to selectively isolate the co-operating latch means when the heald rod resides at said first limit of reciprocal motion and which on actuation renders active the co-operating latch means to enable the motive means to move the heald rod toward said second limit of reciprocal motion.

2. A mechanism according to claim 1 wherein the heald rod selection control means includes a shield located adjacent to the heald rod when at its said first limit of reciprocal motion, the shield being arranged to disengage the co-operable latch means as the motive means and heald rod engaged therewith approach said first limit of reciprocal motion, the shield thereafter serving to isolate the co-operable latch means to thereby prevent said automatic engagement.

3. A mechanism according to claim 2 in which said heald rod has an intermediate position whereat automatic engagement of said co-operating latch means can occur wherein the heald rod selection means further includes heald rod displacement means for moving the heald rod from said first limit of reciprocal motion partially toward said second limit of reciprocal motion so as to move the heald rod to said intermediate position.

4. A mechanism according to claim 3 including synchronizing means for the displacement means and the heald motive means, so that the co-operating latch means move into engagement while the heald rod is being lifted by the displacement means to said intermediate position.

5. A mechanism according to claim 3 including synchronizing means for the displacement means and the heald motive means, such that the heald rod is moved to and held at said-intermediate position prior to engagement of the co-operating latch means.

6. A mechanism according to claim 1 including a second latch means located along the path of reciprocal motion of the heald rod, said second latch means being selectively operable to arrest motion of the heald rod when moving from said second limit toward the first limit of reciprocal motion and thereby cause the heald rod to be held by said second latch means and simultaneously automatically disengaged from the motive means.

7. A heald control mechanism including at least one elongate heald rod movable longitudinally between first and second limits of reciprocal motion;

a heald rod motive means continuously reciprocating along a path parallel to the longitudinal axis of the heald rod;

means biasing the heald rod to normally reside at the first limit of reciprocal motion;

the heald rod and motive means including co-operating latch means which automatically engage when the motive means moves relative to the heald rod along said path in a direction toward the second limit of reciprocal motion and which automatically disengage when the motive means moves relative to the heald rod along said path in the opposition direction; and heald rod selection control means operable to selectively isolate the co-operating latch means when the heald rod resides at said first limit of reciprocal motion and which on actuation renders active the co-operating latch means to enable the motive means to move the heald rod toward said second limit of reciprocal motion, the heald rod selection control means including a shield located adjacent to the heald rod when at its said first limit of reciprocal motion, the shield being arranged to disengage the co-operable latch means as the motive means and heald rod engaged therewith approach said first limit of reciprocal motion, the shield thereafter serving to isolate the co-operable latch means to thereby prevent said automatic engagement, the heald rod selection means further including heald rod displacement means for moving a heald rod from said first limit of reciprocal motion partially toward said second limit of reciprocal motion so as to move the heald rod to an intermediate position between said first and second limits of reciprocal motion whereat automatic engagement of the co-operating latch means can occur.

8. A mechanism according to claim 7 including a second latch means located along the path of reciprocal motion of the heald rod, the second latch means being selectively operable to arrest motion of the heald rod when moving from said second limit toward the first limit of reciprocal motion and thereby cause the heald rod to be held by the selectively operable latch means and simultaneously automatically disengaged from the motive means.

9. A mechanism according to claim 8, including a displacement latch formation located on the heald rod at a position adjacent to the selectively operable latch means when the heald rod resides at its first limit of reciprocal motion, said selectively cooperable latch means being movably mounted for reciprocal, movement along a path parallel to the longitudinal axis of the heald rod, the selectively operable latch means co-operating with said latch formation to comprise said heald rod displacement means.

10. A mechanism according to claim 9 including drive connections between the selectively operable latch means and the heald motive means to cause said reciprocal movement.

11. A mechanism according to claim 8 including a secondary heald rod motive means to continuously reciprocally move the heald rod from its first limit position to said intermediate position, the selectively operable latch means being stationarily mounted and on actuation cooperating with said latch formation to retain the heald rod at said intermediate position to thereby enable the co-operable latch means to automatically engage to move the heald rod to said second limit of reciprocal motion.

12. A mechanism according to claim 11 having multiple heald rods all movable longitudinally between said first limit of motion, said intermediate position and said second limit of motion, wherein the secondary heald rod motive means includes cam means operable on all heald rods so as to move all heald rods in unison to said intermediate position.

* * * * *

UNITED STATES PATENT AND TRADEMARK OFFICE

CERTIFICATE OF CORRECTION

PATENT NO. : 5,628,347

DATED : May 13, 1997

INVENTOR : John B.D. Rush

It is certified that errors appear in the above-identified patent and that said Letters Patent is hereby corrected as shown below:

Column 9, line 11, before "latch 34" insert --knife--;

line 16, delete "knife" and insert --of the--;

Column 10, line 34, change "25 1" to --251--.

Signed and Sealed this

Seventeenth Day of March, 1998

*Attest:*

*Attesting Officer*

BRUCE LEHMAN

*Commissioner of Patents and Trademarks*